United States Patent [19]

Ghis

[11] Patent Number: 5,075,683

[45] Date of Patent: Dec. 24, 1991

[54] METHOD AND DEVICE FOR CONTROLLING A MATRIX SCREEN DISPLAYING GRAY LEVELS USING TIME MODULATION

[75] Inventor: Anne Ghis, D'Heres, France

[73] Assignee: Commissariat a l'Energie Atomique, Paris, France

[21] Appl. No.: 365,688

[22] Filed: Jun. 14, 1989

[30] Foreign Application Priority Data

Jun. 29, 1988 [FR] France ..... 88 08756

[51] Int. Cl.[5] ..... G09G 3/00

[52] U.S. Cl. ..... 340/793; 340/505

[58] Field of Search ..... 340/793, 805, 767; 358/236, 240, 241

[56] References Cited

U.S. PATENT DOCUMENTS

| | | | |
|---|---|---|---|
| 4,193,095 | 3/1980 | Mizushima . | |
| 4,554,539 | 11/1985 | Graves . | |
| 4,841,294 | 6/1989 | Clerc | 340/793 |
| 4,921,334 | 5/1990 | Akodes | 340/793 |

FOREIGN PATENT DOCUMENTS

| | | |
|---|---|---|
| 0051521 | 5/1982 | European Pat. Off. . |
| 0193728 | 9/1986 | European Pat. Off. . |
| 3329130 | 8/1982 | Fed. Rep. of Germany . |
| 2188183 | 9/1987 | United Kingdom . |

*Primary Examiner*—Jeffery A. Brier
*Assistant Examiner*—Chanh Nguyen
*Attorney, Agent, or Firm*—Michael N. Meller

[57] ABSTRACT

A process and device for controlling a matrix screen displaying gray levels, wherein during the line time T activation signals are delivered to the columns of the screen for a time depending on the gray level i of the image point in question and equal to (T/N).Nil, where $O \leqq i \leqq m \leqq N$, the Nils forming a strictly increasing sequence of i of first term zero and of last term lower than or equal to N, the Nils being so selected as to obtain a predetermined distribution for the light intensities of the different gray levels.

Application to the control of microdot or liquid crystal matrix screens.

11 Claims, 5 Drawing Sheets

METHOD AND DEVICE FOR CONTROLLING A MATRIX SCREEN DISPLAYING GRAY LEVELS USING TIME MODULATION

BACKGROUND OF THE INVENTION

The invention relates to a method and device for controlling a display matrix screen adapted to display images having gray levels. It applies more particularly to the control of microdot fluorescent screens or liquid crystal screens. The images can be in black and white or in colour, the term gray level meaning in the latter case colour halftone.

To control the displaying of images on a matrix screen, the following method of sweep is generally used: the lines are successively addressed—i.e., taken from one appropriate potential Vlp to another appropriate potential Vla—once per image and for a time T (line time) which is identical for all the lines and is equal to the quotient of the duration of an image by the number of lines; simultaneously with the addressing of each line, the columns receive signals allowing the control of the respective states of the image elements, or pixels, of the line in question, as a function of the required image: a column is taken to an appropriate potential Vca if the corresponding pixel is to be illuminated, and to another appropriate potential Vce if on the other hand the corresponding pixel is to be extinguished. At the end of the time T, the addressing of the line in question ceases and the following line is addressed, the signals received by the columns depending on the respective required states of the pixels of this following line, and so on.

Techniques are also known allowing the production of images comprising gray levels:

A first technique consists in subjecting a column to a potential intermediate between Vca and Vce, so that the corresponding pixel has an intermediate brightness between that corresponding to the illuminated pixel and that corresponding to the extinguished pixel.

However, more particularly in the case of a microdot fluorescent screen, it is very difficult to control an intermediate voltage between Vca and Vce for a given brightness. because of the rigidity of the voltage/brightness characteristic of such a screen.

The second technique consists in taking a column to the potential Vca for only a fraction of the line time proportional to the quantity of light required for the corresponding pixel and in then returning the column to the potential Vce for the remainder of the line time (time modulation of the control potential of each column).

However, the relation between the time of application of Vca and brightness is not fully linear and, more particularly in the case of a microdot fluorescent screen, there is a strongly non-linear relation between the time of application and brightness, because of the time for establishing the voltage at the terminals of a pixel.

Moreover, in the case of one or other of the two aforementioned known techniques, the time for establishing the voltage at the terminals of a pixel also depends on the resistance of access to such pixel connected with its position in the screen. Consequently, the charge time of the pixel also depends on that position: for the same control potential two pixels, for example, situated at the two ends of the same column do not have the same brightness, the pixel closest to the column contact to which the control potential is applied having the strongest brightness.

BRIEF STATEMENT OF THE INVENTION

The invention relates to a process and apparatus for controlling a matrix screen displaying gray levels, which use a time modulation of the control potential of each column and do not therefore have the disadvantage of the first aforementioned known technique, neither do they cause any problems of non-linearity, like the second aforementioned technique.

More precisely, the invention first of all relates to a method of controlling a display matrix screen adapted to display images gray levels which are located by integers progressively increasing from 0 to an integer m at least equal to 1, the screen comprising a plurality of lines and a plurality of columns whose intersections are respectively associated with image elements, wherein for each image the lines are successively activated for a given time T, known as the line time and identical for all the lines, and on the activation of each line the columns are respectively controlled by signals adapted to activate the columns, each signal being applied for a time which depends on the gray level of the image element corresponding to the intersection of the activated line in question and the column controlled by the signal in question, wherein the line time T is subdivided into N equal intervals of time dt, N being an integer at least equal to m; each gray level i of each line is associated with a selected integer Nil of intervals dt, l representing the number of the line in question, the numbers Nil forming for every fixed l a strictly increasing sequence of the variable i, of first term NO1 zero and of last term Nml lower than or equal to N; and the time during which said signal is applied is equal to the product of dt by that number of said sequence which corresponds to said line and said gray level, said column being deactivated after said time during which said signal is applied, until the activation of the following line, the numbers Nil being so selected as to obtain a predetermined distribution for light intensities of the different gray levels.

Clearly, therefore, the invention allows the correlation of the time of application of the potential Vca during the line time with the voltage/brightness characteristic of the screen in question.

The use of the Nil quantities according to the invention and the possibility of selecting such quantities means that it is possible subsequently—i.e., when the screen and the electronic circuits associated therewith are ready to operate or have even already operated—to balance the obtained gray levels in relation to one another, either to obtain a particular, regular or logarithmic scale of gray, for example, or to compensate edging of the screen/circuits assembly, or to select a better compromise between coupling and brightness.

It should be remembered in this respect that the coupling in question is a phenomenon bound up with the resistance of access to different pixels and takes the visual form of "burr" from one screen line to another.

For every couple of lines 11 and 12, the sequence of numbers Nil1 and Nil2 can be identical (non-differentiation of the screen lines), the lines 11 and 12 not necessarily being successive lines.

In that case the gray levels can be controlled as follows:

at least two zones corresponding to the gray level 0 and the gray level m respectively are formed on the screen, the fraction of line time during which the columns are activated for the image elements with gray level m is varied until a desired image quality is obtained on the screen, a uniform image is formed on the screen which has the gray level m thus defined, and the brightness of such uniform image is measured, from such measured brightness value that brightness is calculated which must be obtained for each of the other gray levels 1 with m−1, as a function of a selected scale of gray levels, and for each of the other gray levels a uniform image is formed on the screen which has the other gray level, and the number of said sequence corresponding thereto is so adjusted as to obtain the calculated brightness for said other gray level, On the other hand, for certain lines 11, 12 of the screen, the sequences of numbers Nil1 and Nil2 may not be identical (differentiation of the screen lines).

In that case the time of application of the potential Vca during the line time can be correlated not only with the voltage/brightness characteristic of the screen, as already indicated, but also with the position of the pixel addressed in the screen.

When the sequences Nil1 and Nil2 are not identical for certain lines 11, 12 of the screen, the maximum gray levels can be controlled as follows:

the respective brightnesses of all the lines of the screen are measured when said lines are at the maximum gray level, and the weakest brightness line is determined, which is taken as a reference, and for each of the other lines 1 the number Nml corresponding to the maximum gray level is so adjusted that the resulting brightness is equal to the reference brightness.

In that case the other gray levels 1 to m−1 can then be controlled as follows:

from such measured brightness value that brightness is calculated which must be obtained for each of the other gray levels 1 with m−1, as a function of a selected scale of gray levels, and for each of the other gray levels a uniform image is formed on the screen which has the other gray level, and the number of said sequence corresponding thereto is so adjusted as to obtain the calculated brightness for said other gray level.

Preferably Nml is lower than N, something which enables the "burr" from one line to another to be eliminated, as will be more clearly shown hereinafter.

The invention also relates to an apparatus for controlling a display matrix screen adapted to display images having gray levels which are located by integers progressively increasing from 0 to an integer m at least equal to 1, the screen comprising a plurality of lines and a plurality of columns whose intersections are respectively associated with image elements, the device comprising:

means provided for successively activating the lines during a given time T known as the line time, which is identical for all the lines and for each image, and means for controlling the columns which are provided to produce during the activation of each line, signals adapted to activate the columns respectively, each signal being applied for a time which depends on the gray level of the image element corresponding to the intersection of the activated line in question and the column controlled by the signal in question, the means controlling the columns comprising:

means which are common to all the columns and comprise:

means provided to produce pulses of period dt equal to T/N, N being an integer at least equal to m, memorizing means provided to memorize, at least for each gray level i of each line which is not zero, an information item connected with a selected integer Nil, 1 denoting the number of the line in question, the numbers Nil forming for any fixed 1 a strictly increasing sequence of the variable i of last term Nml lower than or equal to N, and means provided to apply said signal for a time equal to the product of dt by that number of said sequence which corresponds to said line and said gray level, and to deactivate said column after said time during which said signal is applied, until the activation of the following line, the application time of any signal corresponding to the display of an image element of gray level 0 being zero, the numbers Nil being so selected as to obtain a predetermined distribution for the light intensities of the different gray levels.

In a particular embodiment of the apparatus according to the invention, the means for controlling the columns also comprise a shift register whose number of positions is equal to the number of columns and which receives at its input information items of gray level for the columns, each position being associated with a given column and occupied during the activation of a line by the information item of gray level i relating to such column, the means provided for applying said signal comprising for each column:

a register which receives at its input the information item contained in the corresponding position of the shift register and which is controlled by start-of-line signals, and a comparator with two inputs, whose first input is connected to the output of said register and whose output controls the activation of the corresponding column via amplification means, and the means common to all the columns are provided to deliver to the second input of each comparator information items representing integers k, such information items so varying increasingly from 0 to m during the line time that the column corresponding to the comparator is activated as long as k is lower than i, then deactivated and maintained in the deactivated state as soon as k reaches i until the activation of the following line.

In a first particular embodiment of the apparatus according to the invention the numbers Nil1 and Nil2 being equal, for any couple of lines l1 and l2 and for each gray level i, the means common to all the columns also comprise:

a first counter provided for reverse counting, and a second counter which is zero reset when a line starts and is incremented by an end-of-counting signal emitted by the first counter and which delivers to the second input of each comparator the information items representing the numbers k, the first counter being decremented by the means provided for producing the pulses, the memorizing means comprising at least m registers numbered from 0 to m−1 and an address bus to which the information items representing the numbers k are delivered, the output signals of the memorizing means controlling the initialization of the first counter, which takes into account said output signals during the emission of its end-of-counting signal, and the information item presents at the address i memorizing means, i taking any of the values 0 to m−1 being equal to the difference between the numbers N(i+1)l and Nil.

Lastly, in a second particular embodiment, the sequences of numbers Nil1 and Nil2 not being identical for certain lines l1, l2 of the screen, the means, to all the columns also comprise:

a first counter provided for reverse counting, a second counter which is zero reset when a line starts and is incremented by an end-of-counting signal emitted by the first counter and which delivers to the second input of each comparator the information items representing the numbers k, and a third counter which is zero reset at the start of an image and incremented at each line start, the first counter being decremented by the means provided for producing the pulses, the memorizing means comprising at least mxL registers, L being the number of lines, and an address bus to which the information items are delivered which represent the numbers k in the form of binary words in two parts, the part of heavy weight corresponding to the output signals of the third counter, and the part of lightweight corresponding to the information items representing the numbers k, the output signals of the memorizing means controlling the initialization of the first counter, which takes into account said output signals during the emission of its end-of-counting signal, and the information item presents at the address ixl of the memorizing means, i taking any of the values 0 to m−1 and l taking any of the values 1 to L being equal to the difference between the numbers N(i+1)l and Nil.

LIST OF DRAWINGS

The invention will be more clearly understood from the following description of purely exemplary non-limitative embodiments thereof, with reference to the accompanying drawings, wherein:

FIG. 1 illustrates diagrammatically the principle of a "all or nothing" display for a microdot fluorescent screen, FIG. 2 illustrates diagrammatically the principle of the invention for such a microdot fluorescent screen, FIG. 3 shows the variations in electronic current in dependence on the voltage between the cathode and the grid for a given screen of the preceding kind, FIG. 4 illustrates diagrammatically the advantage according to the invention of subdividing the line time T into a number N of intervals dt higher than the maximum gray level m, FIG. 5 is a diagrammatic view of a first particular embodiment of the apparatus according to the invention, and FIG. 6 is a diagrammatic view of a second particular embodiment of the device.

DESCRIPTION OF THE PREFERRED EMBODIMENT

Figure 1:
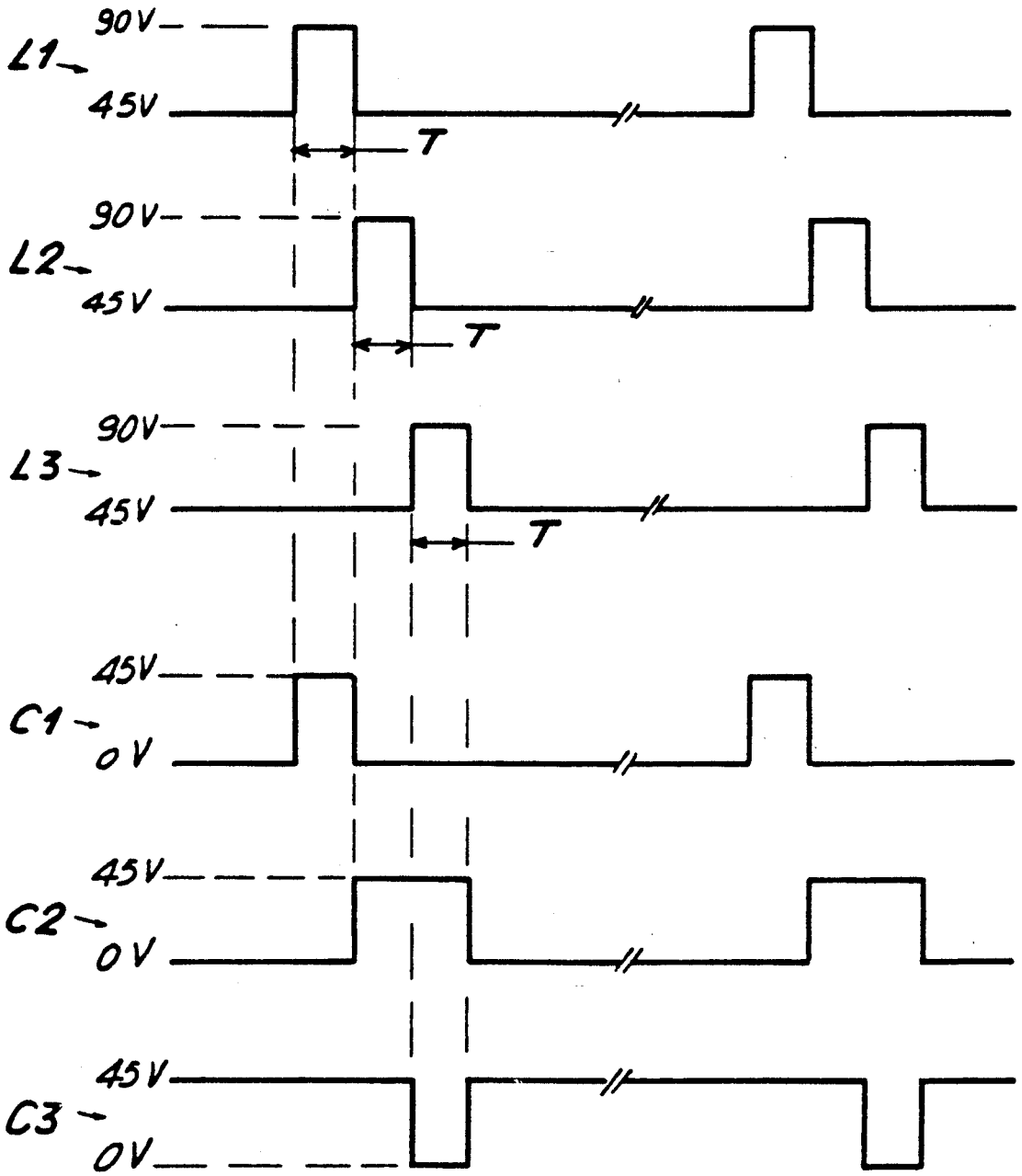

FIG. 1 illustrates diagrammatically the principle of "all or nothing" display in the case of a particular microdot fluorescent screen. The term "all or nothing display" means a display in which each pixel can only be either in the extinguished or the illuminated state, without an intermediate state. FIG. 1 shows successive addressings of the three first lines of the screen L1, L2 and L3. At a given moment each line passes from a potential Vlp=45 V to a potential Vla=90 V, which it maintains during the line time T, to then return to the potential Vlp=45 V at the moment when the following line passes from the potential 45 V to the potential 90 V . . . When all the lines have been addressed, the first line is addressed again, and so on.

FIG. 1 also shows particular addressing signals of the three first columns C1, C2 and C3 of the screen, the signals leading to the following image on the screen: pixels corresponding to the intersections of the columns C1, C2 and C3 with the line L1 are in the extinguished, illuminated and extinguished states respectively; the intersections of these columns with the line L2 lead to pixels in the illuminated, extinguished and extinguished states respectively, and the same intersections with the line L3 lead to pixels in the illuminated, extinguished and illuminated states respectively. Thus, for example, when the line L1 is activated, the potential applied to the contact of the column C1 passes from Vce=0 V to Vca=45 V, then returning to 0 V during the successive addressings of the lines L2 and L3.

The method according to the invention will now be described: according to the invention the line time T is divided into N equal intervals dt. Let it be supposed that a display capacity is required of m+1 gray levels located by the number 0 (pixel extinguished), 1, . . . , m (maximum gray level corresponding to an illuminated pixel). The number N is at least equal to m. In practice, N is much larger than m. A number Nil of intervals dt is associated with each gray level i of each of the lines l of the screen. The gray level 0 (pixel extinguished) is associated with interval O, whatever the number l of the line may be. In other words, NO1 is zero, whatever l may be.

Moreover the number of intervals dt associated with each of the gray levels increases strictly with the brightness of such gray level. In other words, for any fixed l, the sequence of numbers Nil is a strictly increasing sequence of the variable i.

Moreover, the maximum gray level m (corresponding to an illuminated pixel) is associated with a number of intervals Nml lower than or equal to N, whatever l may be.

For a given addressed line, the column electrode whose pixel must have a brightness of gray level i which is not zero is taken, at the start of the line time T, to the activation potential Vca (0 V for certain microdot fluorescent screens) and maintained at such potential for Nil intervals of time dt, l being the number of the line in question, whereafter the electrode is returned to the extinction potential Vce (45 V for microdot fluorescent screens) until the start of the following line.

Figure 2:
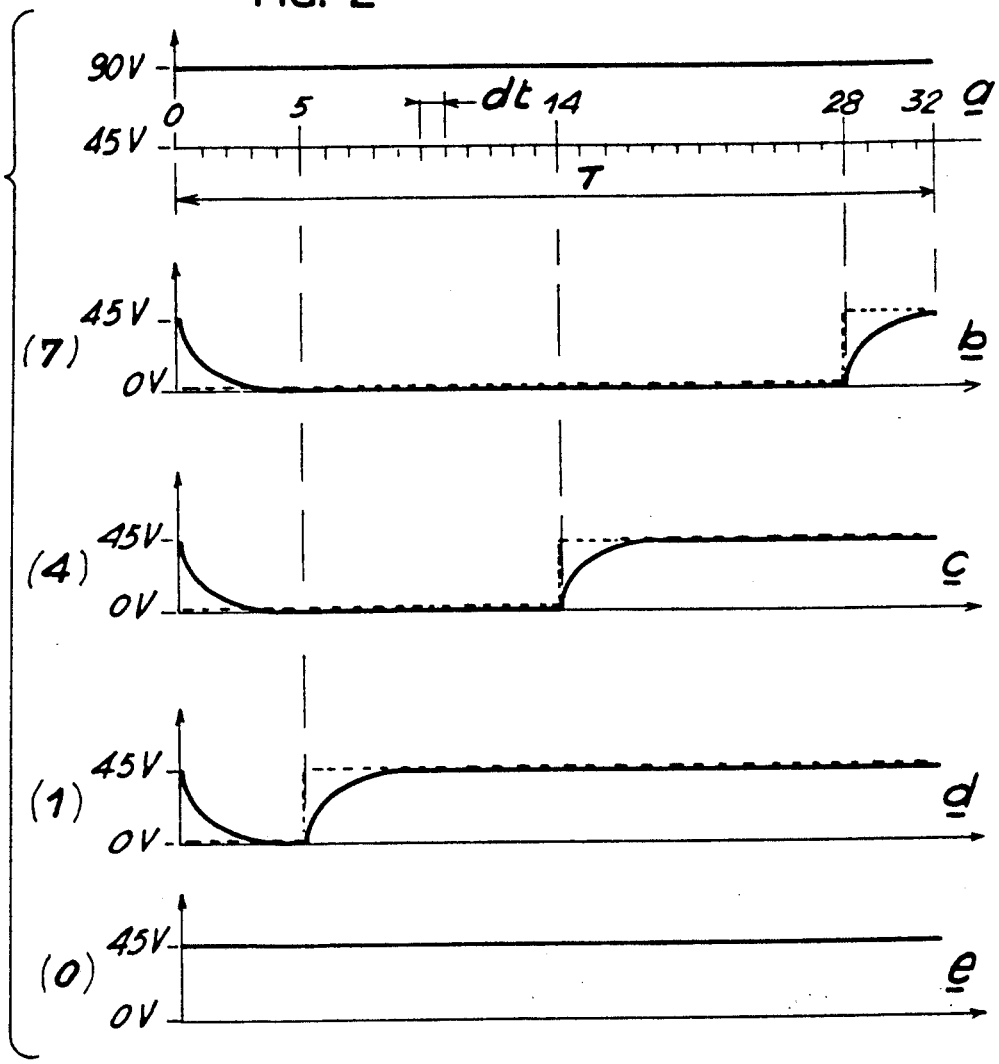

The method according to the invention is illustrated by FIG. 2, showing the case of a particular microdot fluorescent screen: in this example the line time T is subdivided into 32 intervals dt (a) with a view to expressing 8 gray levels (0 to 7). The numbers N and m are therefore equal to 32 and 7 respectively.

Four gray levels 0, 1, 4 and 7 are considered, and for each of these levels the time graph is shown of the control signal applied to a column contact to display such level (in chain lines) and also the behaviour of such column (in continuous lines) during the line time T. It will be noted that in FIG. 2 the gray level 7 ("white'-'—i.e., illuminated points) corresponds to N7l=28 intervals dt (b), l denoting the number of the line in question, but the gray level 4 is associated with N4l=14 intervals dt (c), that the gray level 1 (pixel almost extinguished) is associated with N11=5 intervals dt (d), and that the gray level 0 (black dot—i.e., extinguished) is associated with N0l=0 interval dt (e).

An example showing the improvement of the performance of a microdot fluorescent screen by the method according to the invention is given in Table I, which is to be found at the end of the description, and wherein the lines are not differentiated: for any couple of lines l1, l2 and for each gray level i the numbers Mil1 and Nil2 are equal.

Figure 3:
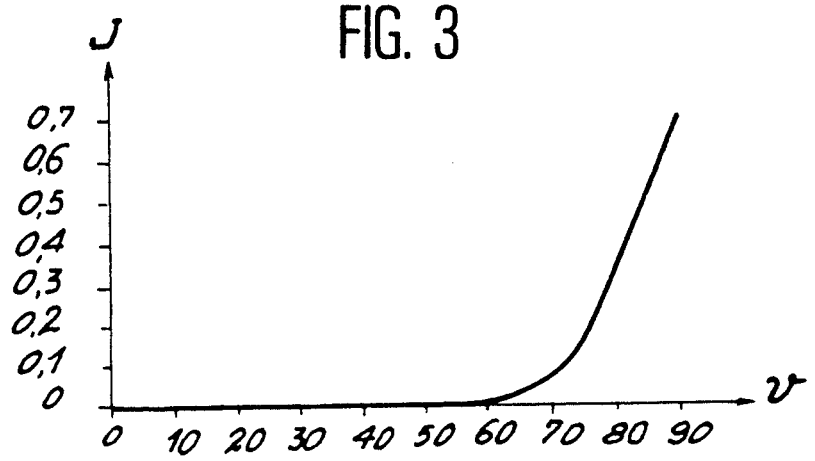

In Table 1 the gray levels extend from 0 to m=15, the numbers Ni1 associated therewith according to the invention ranging from Nol=0 to N15l=355. The gray levels obtained with a regular distribution in time in the second aforementioned known technique (application time of Vca proportional to the required brightness) are also compared with the gray levels obtained with an adjusted distribution according to the invention for a microdot fluorescent screen whose emission characteristic is shown in FIG. 3. The charge resistance of each column of the screen is 10 kilo-ohms, the charging capacity per column being 1 nanofarad, the line time being 64 microseconds, and the line time being subdivided into N=640 equal intervals dt.

FIG. 3 shows the variations in the intensity J of the electronic current expressed in milliamps per square millimetre as a function of the voltage v between a cathode (column) and a grid (line) of the screen, expressed in volts.

Table I indicates for each gray level i the value obtained for the ratio (in per cent) of the brightness Ii corresponing to such gray level and the brightness corresponding to the maximum gray level (15), on the one hand with the invention, by experimentally determining the numbers Nil so as to obtain a regular distribution of brightness, and on the other hand with the prior art (second aforementioned known technique).

It will be noted that the invention allows the obtaining of brightness ratios which increase substantially in arithmetical progression, something which is not the case in the prior art.

Moreover, with the regular distribution of brightness according to the invention as shown in Table I, the coupling is limited to 2.7% of the current emitted by a dot of gray level 15, such coupling being zero for the other levels 0 to 14.

Figure 4:
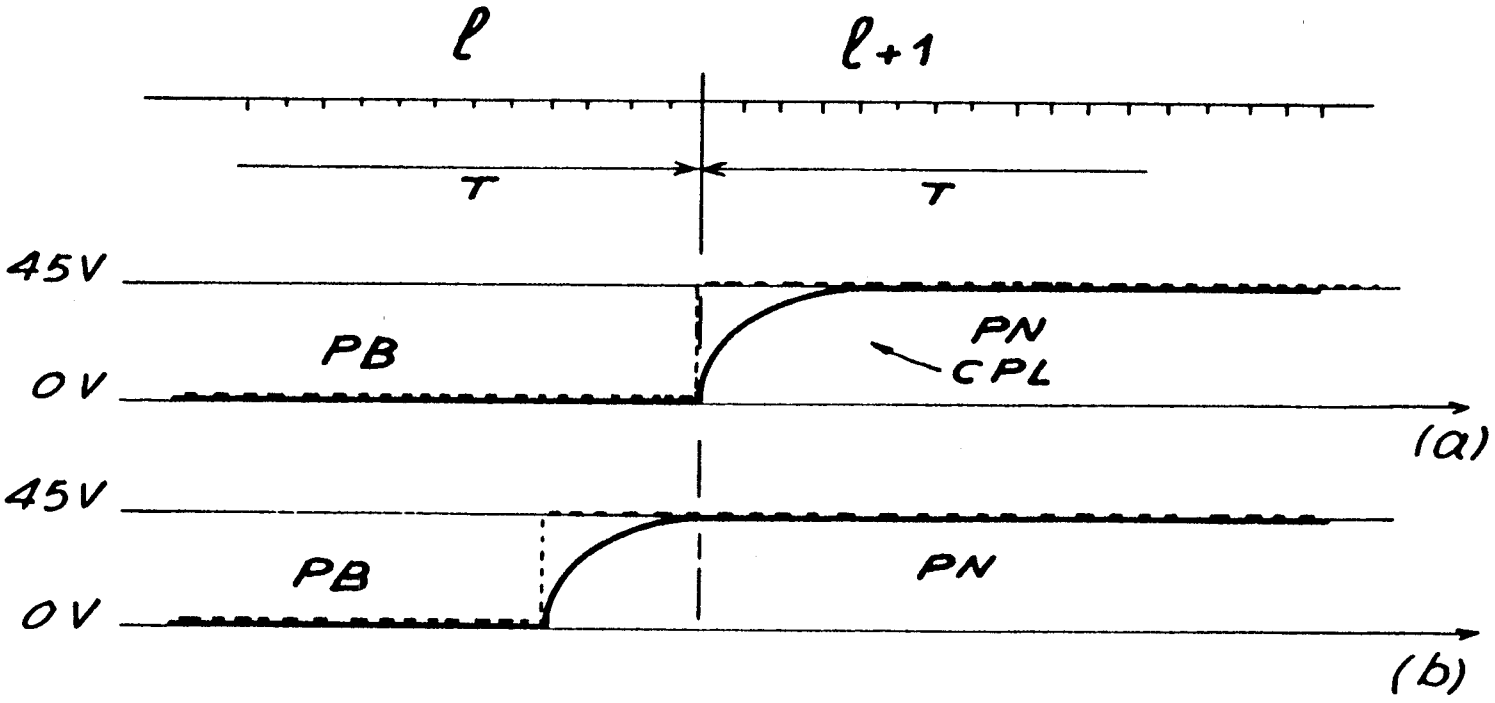

FIG. 4 shows diagrammatically the advantage of not attributing N intervals dt to the maximum gray level m. A line a of a microdot fluorescent screen and the following line l+1 are considered. It is supposed that a pixed PB of line l corresponds to an illuminated point (gray level m) and that the pixel PN belonging to the same column as PB and situated on the line l+1 corresponds to an extinguished dot (gray level 0). In case (a), in which N intervals dt are attributed to the most important gray level, it can be seen that their exists a coupling CPL between the pixels PB and PN, the chain lines corresponding to the control signal applied to the contact of the column in question, and the solid line corresponding to the behaviour of such column during the line time T. Because of this coupling, light is emitted parasitically on the line l+1. In contrast, in the case (b), in which the number of intervals dt attributed to the most important gray level is lower than N, there is no such parasite emission.

An explanation will now be given of how to determine the number of intervals Nil to be associated with each gray level i. We shall first consider the case in which the lines are not differentiated. The numbers Nil can be determined as follows:

the image of a chessboard, or a succession of alternately illuminated bands (maximum gray level) and extinguished bands (0 gray level) is formed on the screen. It is enough to form an image comprising an extinguished part and an illuminated part, and more precisely an image comprising at least on one column an illuminated point immediately followed by an extinguished point.

Then the fraction of line time is varied during which the electrodes of the columns are maintained at the activation potential for the illuminated pixels, either by varying Nml with a constant N, or by varying N with a constant Nml. In this way the best compromise is sought between the coupling and brightness, knowing that in proportion as Nml/N is greater, brightness is better but coupling is stronger.

Then a uniform image of gray level m resulting from the preceding compromise is formed on the screen and the brightness of the image is measured, for example, by a phototometer or by measuring the anode current (in the case of a microdot fluorescent screen).

From this brightness value for the gray level m, the brightness is calculated which must be obtained for each of the other gray levels on a scale of brightness which has been adopted (a regular or logarithmic scale, for example).

Lastly, for each of these other gray levels a uniform image of such other level is formed on the screen, and the number of intervals dt associated with such other level is so adjusted as to obtain the brightness previously calculated for such other level.

It will be noted that the controls carried out are valid for all screens having the same characteristics, the same number of lines and the same number of columns: in the case of identical, continuously produced screens, there is no need to perform these controls again for each of the screens.

If the lines are differentiated, first of all the maximum gray level of each of the lines can be controlled as follows:

First the weakest line of brightness is determined by measuring the respective brightnesses of all the illuminated lines, successively, for example. The weakest line of brightness is generally the last line—i.e., the one furthest away from the contacts enabling the columns of the screen to be addressed.

Then, for each other line the number of intervals dt is adjusted which must be attributed to the maximum gray level of such other line, so that it has the same brightness as said weakest brightness, the latter being taken as a reference. During this control, only said other line in question is illuminated on the screen.

Then, from the value taken as a reference it is possible to calculate the brightness which must be obtained for each of the other gray levels in accordance with a scale which has been fixed. Then, for each of such other gray levels the lines of the screen are successively activated thereon, and the number of intervals dt associated with such other level and with the line in question are so adjusted as to obtain the brightness previously calculated for said other level.

Figure 5:
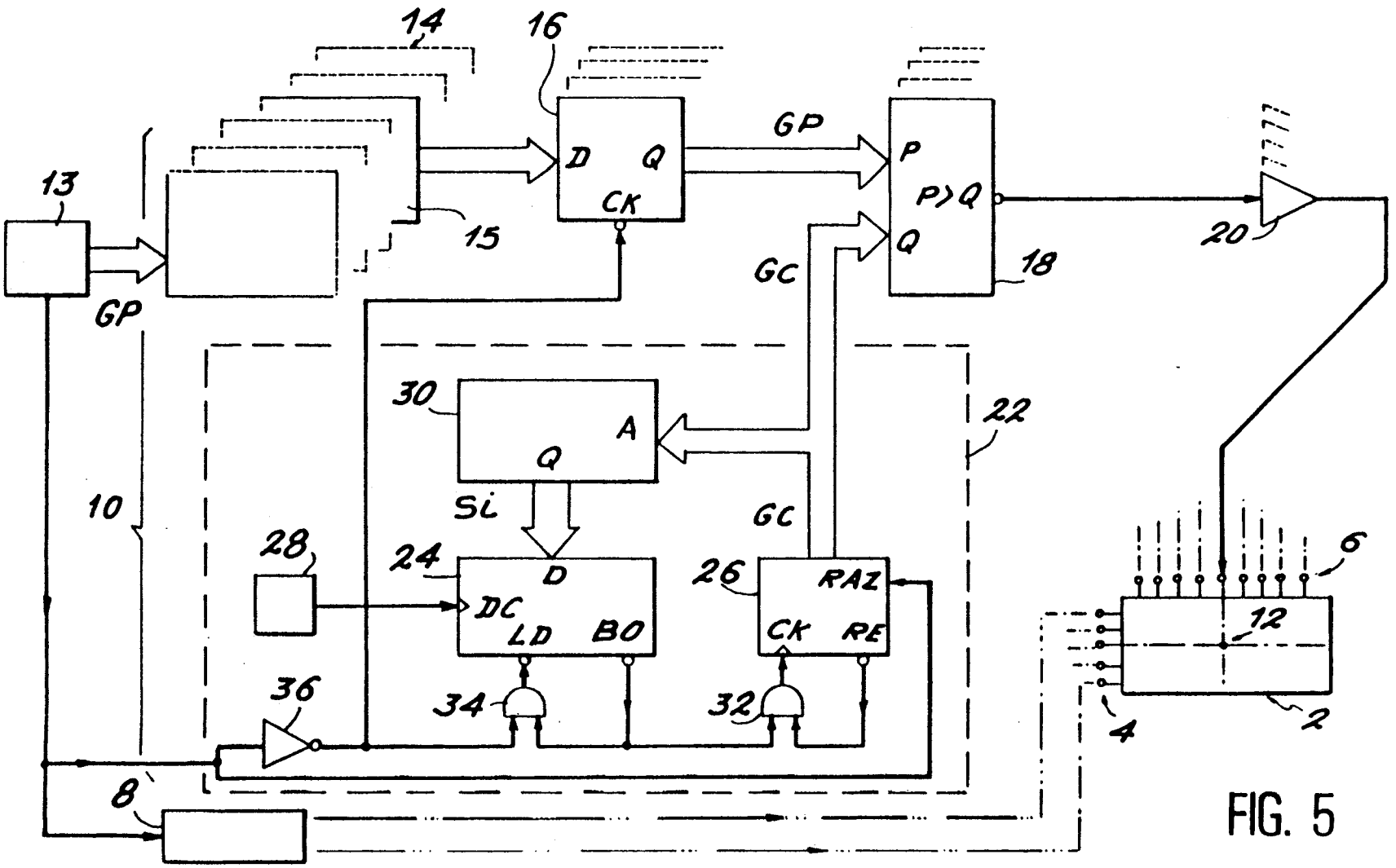

FIG. 5 shows diagramatically a first particular embodiment of the apparatus according to the invention allowing the control of a matrix screen 2, for example, a microdot fluorescent screen, for which the lines are not differentiated from the aspect of their brightness. The screen comprises an assembly of lines 4 parallel with one another and an assembly of columns 6 which are parallel with one another and perpendicular to the lines. The end of each line has a line contact on the same side of the screen. Similarly, the end of each column has a column contact on the side of the scren adjacent the preceding one.

The apparatus shown in FIG. 5 comprises means 8 for controlling the lines and means 10 for controlling the columns. The intersection of a given line and a given column defines an image element 12 which appears on the screen when said line and said column are appropriately addressed.

Let us suppose, for example, $m=15$, whence 16 gray levels located by the numbers 0, 1, . . . , 15, which can be coded on 4 bits in the binary system. (For $m+1$ gray levels, the latter are coded on p bits, such that $2^p \geqq m+1$).

The device shown in FIG. 5 also comprises means 13 provided to supply the information items concerning the gray levels of the pixels, such information items being coded in the binary system on 4 bits and denoted by GP, and the synchronization pulses, more particularly those of the start of the line.

The means 10 also comprise:

a shift register 14 having as many positions as there are columns in the screen, each position comprising 4 bits (if $m=15$), for each column a register 16 of 4 bits which, in the embodiment shown in FIG. 5, is a D flip-flop of 4 bits, and a comparator 18 and means 20 for amplifying the control signal of the column in question, and means 22 which are common to all the columns and will be described hereinafter.

The information items GP are successively presented at the input of the shift register 14 and so displaced therein that at the start of the addressing of a line, each information item which is associated with a pixel occupies that position in the shift register which is associated with the column corresponding to such pixel. At the start of the addressing of the line, each information item GP is transferred from its position in the register 14 to the inputs D of the flip-flop 16 of 4 bits associated with such position. The non-inverting-outputs Q of the flip-flop are delivered to one P of the two inputs (4 bits) of the comparator 18 of $2\times4$ bits, the other input Q (4 bits) of the comparator receiving information items GC which are common to all the controls of columns and coded on 4 bits. The information items GC which have come from the means 22 common to all the columns develop increasingly during the course of the line time T. The output of the comparator 18 is connected to the input of the corresponding amplification means 20 whose output controls the corresponding column.

While the value GP is greater than the value of GC, the output of the comparator 18 remains at the logic level 0 and the column contact corresponding to the comparator 18 in question is maintained at the potential 0 volts (activation). As soon as the value GC becomes equal to GP and then higher than such value GP, the output of the comparator 18 passes to and remains at the logic level 1, and the contact in question is taken to and maintained at the potential of 45 volts (extinction).

The means 22 which are common to all the columns comprise a first counter 24 of 8 bits adapted for reverse counting, a second counter 26 of 4 bits, a clock 28 and a memory 30.

The counters 24 and 26 are, for example, of the type 74193.

The means 22 also comprise a first AND gate 32 and a second AND gate 34. The output of the gate 32 is connected to the clock input CK of the counter 26. The output of the gate 34 is connected to the load (inverting) input LD ("load") of the counter 24. An input of the gate 32 is connected to the retaining (inverting) output RE ("carry") of the counter 26 and the end-of-counting (inverting) output BO ("borrow") of the counter 24 is connected to the other input of the gate 32 and to an input of the gate 34.

The means 13 are provided to deliver a start-of-line information item to the means 8 for controlling the lines and to the zero resetting input RAZ of the counter 26. This start-of-line information item is also delivered to the clock input CK ("latch") of each flip-flop 16 and to the other input of the gate 34 via an inverter 36.

FIG. 5 shows that the clock input of the flip-flop 16 is an inverter: the start-of-line pulse (logic state 1) is inverted a first time (logic state 0) by the inverter 36. then a second time (logic state 1) at the CK of the flip-flop 16, which is therefore charged with the information item contained in the corresponding position of the register 14 when the start-of-line pulse is emitted.

The clock 28 is a regular clock of frequency 1/dt—i.e.. N/T. The pulses supplied by the clock are delivered to the countdown inpt DC ("down") of the counter 24.

The information items GC coded on 4 bits leave the counter 26 and are delivered on the one hand to the input Q of each of the comparators 18 and on the other hand to the address bus A of the memory 30 (the contents of the counter 26 therefore corresponding to an address of the memory). The memory 30 is a memory of 15 words of 8 bits. The outputs Si of the memory 30 are presented to the initialization bus of the counter 24.

The counter 26 is zero reset at the start of the line and incremented by a signal of the end of counting down emitted by the output BO of the counter 24, since at the end of each countdown, the output BO of the counter 24 passes to the logic state 1 and, the output RE of the counter 26 being at the logic state 1, the input CK of the counter 26 receives a-pulse. The counter 24 is decremented by the clock 28 and takes into account the outputs Si of the memory 30 during the emission of its signal of the end of counting down, since this signal corresponds to the passage of the output BO of the computer 24 to the logic state 1 and, since the output of the inverter is at the logic state 1, the input LD of the counter 4 receives a pulse.

The information item Si is placed at the address i of the memory and is equal to the number of intervals dt to be counted to pass from the number of intervals corresponding to the gray level i to the number of intervals corresponding to the gray level $i+1$.

To obtain the results indicated in Table I, the contents of the memory 30 are as follows:

| | Address | | | | | | | |
|---|---|---|---|---|---|---|---|---|
| | 0 | 1 | 2 | 3 | 4 | 5 | 6 | 7 |
| Contents | 116 | 30 | 23 | 20 | 18 | 17 | 17 | 16 |
| | Address | | | | | | | |
| | 8 | 9 | 10 | 11 | 12 | 13 | 14 | 15 |
| Contents | 15 | 15 | 14 | 14 | 14 | 13 | 13 | — |

It can be seen in this example that the contents of the address 15 of the memory does not matter, since it is ignored.

The means 22 therefore operate as follows: at the start of a line the counter 26 is zero reset. Its contents are then 0. At the address 0, the memory 30 comprises the number of intervals dt corresponding to the gray level 1. This number is transferred to the counter 24, which is decremented by the clock 28 of frequency 1/dt. When the counter 24 is at zero, it delivers a pulse to the counter 26 which is incremented as a result of the pulse. The new contents of the counter 26 are then 1. At the address 1, the memory 30 comprises the supplementary number of intervals to be counted to reach the number of intervals corresponding to the gray level 2. This supplementary number is transferred to the counter 24 . . . and so on.

When the contents of the counter 26 reaches their maximum value (15), its output RE passes to the logic state 0, something which blocks it. A fresh cycle starts with a fresh line.

The memory 30 is, for example, of the PROM type. To perform the gray level regulations mentioned hereinbefore, something which implies modifications of the content of the memory, it is enough to replace the memory by a device known as a "PROM emulator", all other things being equal, and, once the controls have been completed, to replace the emulator by the memory 30, into which the values obtained by the emulator are written. Moreover if these controls require a variation of the number N, it is enough for this purpose to change the clock 28.

Figure 6:
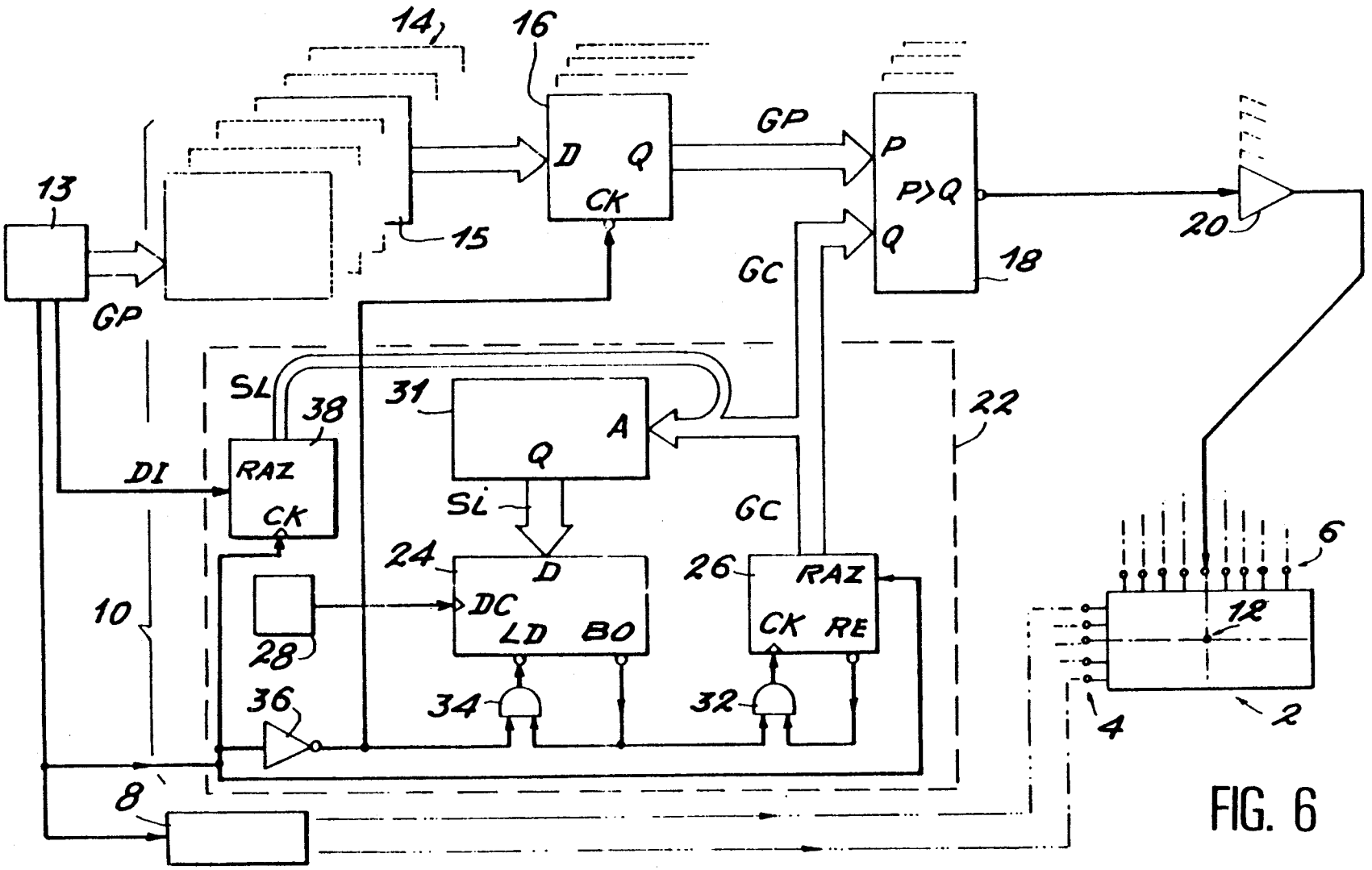

FIG. 6 shows diagrammatically a second particular embodiment of the apparatus according to the invention which enables the screen 22 to be controlled with line differentiation. The apparatus diagrammatically illustrated in FIG. 6 differs from the device illustrated in FIG. 5 in that it also comprises a third counter 38 whose incrementation is controlled by start-of-line pulses (which are delivered to the clock input CK of the counter 38) and whose zero resetting RAZ is controlled by a start-of-image signal DI which is supplied by the means 13. The output number s of the counter 38 is such that $2^s$ is at least equal to L (number of lines on the screen). Also in the apparatus illustrated in FIG. 6 the memory 30 is replaced by a memory 31 of n words of 8 bits, n being at least equal to the product of the number of lines on the screen by the number m, equal to 15 in the example given.

The words presented on the address bus A of the memory 31 comprise a part of low weight and a part of high weight. The outputs SL of the counter 38 form the part of high weight of each of these words, whose part of low weight is the word supplied at the output by the counter 26. The addresses of the memory are therefore located by words of s+4 bits.

The apparatus as described with reference to FIGS. 5 and 6 might be used by an engineer in the art for controlling a liquid crystal matrix screen.

Moreover, the present invention applies to the control of both a black and white and a colour screen.

TABLE 1

| i | Nil Invention | Ii/I15 (%) Invention | Ii/I15 (%) Prior art |
|---|---|---|---|
| 0 | 0 | 0 | 0 |
| 1 | 116 | 6.7 | 0.1 |
| 2 | 146 | 13.3 | 1.1 |

TABLE 1-continued

| i | Nil Invention | Ii/I15 (%) Invention | Ii/I15 (%) Prior art |
|---|---|---|---|
| 3 | 169 | 20.0 | 2.5 |
| 4 | 189 | 26.7 | 6.4 |
| 5 | 207 | 33.4 | 15.8 |
| 6 | 224 | 40.2 | 19.8 |
| 7 | 241 | 47.2 | 27.4 |
| 8 | 257 | 54.3 | 41.1 |
| 9 | 272 | 60.9 | 45.4 |
| 10 | 287 | 67.8 | 54.0 |
| 11 | 301 | 74.2 | 68.9 |
| 12 | 315 | 80.7 | 73.2 |
| 13 | 329 | 87.5 | 81.7 |
| 14 | 342 | 93.7 | 95.7 |
| 15 | 355 | 100 | 100 |

What we claim is:

1. A method of controlling a display matrix screen adapted to display images having gray levels which are located by integers progressively increasing from 0 to an integer m at least equal to 1, the screen comprising a plurality of lines and a plurality of columns whose intersections are respectively associated with image elements, wherein for each image the lines are successively activated for a given time T, known as the line time and identical for all the lines, and on the activation of each line the columns are respectively controlled by signals adapted to activate the columns, each signal being applied for a time which depends on the gray level of the image element corresponding to the intersection of the activated line in question and the column controlled by the signal in question, wherein the line time T is subdivided into N equal intervals of time dt, N being an integer at least equal to m, each gray level i of each line is associated with a selected interger Nil of intervals dt, l representing the number of the line in question, the numbers Nil forming for every fixed l a strictly increasing sequence of the variable i, of first term NOl zero and of last term Nml lower than or equal to N, and the time during which said signal is applied is equal to the product of dt by that number of said sequence which corresponds to said line and said gray level, said column being deactivated after said time during which said signal is applied, until the activation of the following line, the numbers Nil being so selected as to obtain a predetermined distribution for light intensities of the different gray levels.

2. A method according to claim 1, wherein the sequences of numbers Nil1 and Nil2 are identical for any couple of lines 11 and 12.

3. A method according to claim 2, wherein the gray levels are controlled as follows:

at least two zones corresponding to the gray level O and the gray level m respectively are formed on the screen, the fraction of line time during which the columns are activated for the image elements with gray level m is varied until a desired image quality is obtained on the screen, a uniform image is formed on the screen which has the gray level m thus defined and the brightness of such uniform image is measured, from such measured brightness value that brightness is calculated which must be obtained for each of the other gray levels 1 to m−1, as a function of a selected scale of gray levels, and for each of the other gray levels a uniform image is formed on the screen which has the other gray level, and the number of said sequence corresponding thereto is so adjusted as to obtain the calculated brightness for said other gray level.

4. A method according to claim 1, wherein the sequences of numbers Nil1 and Nil2 are not identical for certain lines 11, 12 of the screen.

5. A method according to claim 4, wherein the maximum gray levels are controlled as follows:

the respective brightnesses of all the lines of the screen are measured when said lines are at the maximum gray level, and the weakest brightness line is determined, which is taken as a reference, and for each of the other lines l the number Nml corresponding to the maximum gray level is so adjusted that the resulting brightness is equal to the reference brightness.

6. A method according to claim 5, wherein the other gray levels 1 to m−1 are then controlled as follows:

from the reference brightness value that brightness is calculated which must be obtained for each of the other gray levels 1 to m−1, as a function of a selected scale of gray levels, and for each of the other gray levels and for each line the image of the line is formed on the screen which has the other gray level, and the number of said sequence corresponding thereto is so adjusted as to obtain the calculated brightness for said other gray level.

7. A method according to claim 1, wherein Nml is lower than N for any l.

8. An apparatus for controlling a display matrix screen adapted to display images having gray levels which are located by integers progressively increasing from 0 to an integer m at least equal to 1, the screen comprising a plurality of lines and a plurality of columns whose intersections are respectively associated with image elements, the device comprising:

means provided for successively activating, for each image, the lines during a given time T known as the line time, which is identical for all the lines, and means for controlling the columns which are provided to produce during the activation of each line, signals adapted to activte the columns respectively, each signal being applied for a time which depends on the gray level of the image element corresponding to the intersection of the activated line in question and the column controlled by the signal in question, the means controlling the columns comprising: means which are common to all the columns and comprise:

means provided to produce pulses of period dt equal to T/N, N being an integer at least equal to m, memorizing means provided to memorize, at least for each gray level i of each line which is not zero, an information item connected with a selected integer Nil, l denoting the number of the line in question, the numbers Nil forming for any fixed l a strictly increasing sequence of the variable i of last term Nml lower than or equal to N, and means provided to apply said signal for a time equal. to the product of dt by that number of said sequence which corresponds to said line and said gray level, and to deactivate said column after said time during which said signal is applied, until the activation of the following line, the application time of any signal corresponding to the display of an image element of gray level 0 being zero, the numbers Nil being so selected as to obtain a predetermined distribution for the light intensities of the different gray levels.

9. A device according to claim 8, wherein the means for controlling the columns also comprise a shift register whose number of positions is equal to the number of columns and which receives at its input information items of gray level for the columns, each position being associated with a given column and occupied during the activation of a line by the information item of gray level i relating to such column, the means provided for applying said signal comprising for each column:

a register which receives at its input the information item contained in the corresponding position of the shift register and which is controlled by start-of-line signals, and a comparator with two inputs, whose first input is connected to the output of said register and whose output controls the activation of the corresponding column via amplification means, and the means common to all the columns are provided to deliver to the second input of each comparator information items representing integers k, such information items so varying increasingly from o to m during the line time that the column corresponding to the comparator is activated as long as k is lower than i, then deactivated and maintained in the deactivated state as soon as k reaches i until the activation of the following line.

10. A device according to claim 9, wherein for any couple of lines 11 and 12 and for each gray level i, the numbers Nil1 and Nil2 are equal, the means common to all the columns also comprising:

a first counter provided for reverse counting, and a second counter which is zero reset when a line starts and is incremented by an end-of-counting signal emitted by the first counter and which delivers to the second input of each comparator the information items representing the numbers k, the first counter being decremented by the means provided for producing the pulses, the memorizing means comprising at least m registers numbered from 0 to m−1 and an address bus to which the information items representing the numbers k are delivered, the output signals of the memorizing means controlling the initialization of the first counter, which takes into account said output signals during the emission of its end-of-counting signal, and the information item present at the address i of the memorizing means, i taking any of the values 0 to m−1 being equal to the difference between the numbers N(i+1) l and Nil.

11. A device according to claim 9, wherein for certain lines 11, 12 of the screen, the sequences of numbers Nil1 and Nil2 are not identical, the means common to all the columns also comprising:

a first counter provided for reverse counting, a second counter which is zero reset when a line starts and is incremented by an end-of-counting signal emitted by the first counter and which delivers to the second input of each comparator the information items representing the numbers k, and a third counter which is zero reset at the start of an image and incremented at each line start, the first counter being decremented by the means provided for producing the pulses, the memorizing means comprising at least mxL registers, L being the number of lines, and an address bus to which the information items are delivered which represent the numbers k in the form of binary words in two parts, the part of heavy weight corresponding to the output signals of the third counter, and the part of light-weight corresponding to the information items representing the numbers k, the output signals of the memorizing means controlling the initialization of the first counter, which takes into account said output signals during the emission of its end-of-counting signal, and the information item present at the address ixl of the memorizing means, i taking any of the values 0 to m−1 and l taking any of the values 1 to L being equal to the difference between the numbers N(i+1) l and Nil.

* * * * *